United States Patent [19]

Wright

[11] 4,380,263

[45] Apr. 19, 1983

[54] HEAT EXCHANGER TUBE SUPPORT ASSEMBLY

[75] Inventor: William E. Wright, East Syracuse, N.Y.

[73] Assignee: Carrier Corporation, Syracuse, N.Y.

[21] Appl. No.: 202,984

[22] Filed: Nov. 3, 1980

[51] Int. Cl.[3] ..... F28F 9/00

[52] U.S. Cl. ..... 165/76; 165/125; 165/172

[58] Field of Search ..... 165/76, 125, 162, 172; 62/507, 508, 262, 298

[56] References Cited

U.S. PATENT DOCUMENTS

| | | | |
|---|---|---|---|
| 1,430,769 | 10/1922 | Thompson | 165/162 |
| 1,821,995 | 9/1931 | Wayman | 165/172 |
| 2,126,687 | 8/1938 | Martin | 165/162 |
| 3,007,679 | 11/1961 | Byerley et al. | 165/162 |
| 4,036,621 | 7/1977 | Burton | 165/172 |
| 4,231,421 | 11/1980 | Eaton et al. | 165/125 X |

FOREIGN PATENT DOCUMENTS

| | | | |
|---|---|---|---|
| 1040055 | 10/1958 | Fed. Rep. of Germany | 165/162 |

*Primary Examiner*—Sheldon J. Richter

*Attorney, Agent, or Firm*—Donald F. Daley; Robert P. Hayter

[57] ABSTRACT

Apparatus for use in a heat exchange unit having wound fin tubing includes a tube support having a vertical portion and multiple lateral portions, each lateral portion having an opening therein. A support tube is inserted through the openings in the lateral portions of the tube support such that runs of wound fin tubing are secured between the tube support and the support tube. A run support portion of the tube support may additionally define notches for securing the various runs of wound fin tubing. Pins or other means for securing the tubular support means are inserted into the ends of the tubular support such that the support tube is affixed to the tube support assembly. The pins are secured to either the base pan or the structural assembly of the unit providing a tube support assembly as an integral part of the heat exchange unit.

5 Claims, 5 Drawing Figures

HEAT EXCHANGER TUBE SUPPORT ASSEMBLY

BACKGROUND OF THE INVENTION

1. Field of the Invention

The present invention relates to heat exchanger assemblies. More specifically, the present invention relates to a combination of a support member having various portions and a tubular support means which coact for securing wound fin tubing in a preselected position as well as providing a structural portion of the heat exchange unit.

2. Prior Art

Wound fin heat exchangers are well known in the refrigeration and air conditioning fields. A wound fin heat exchanger consists of a tube having a fin material wrapped about the tube in heat exchange relation therewith to promote heat transfer between fluid flowing through the tube and a separate fluid flowing over the tube. The utilization of this type of heat exchanger, wound fin, has been found to be both cost effective and to provide the appropriate heat transfer with a minimum of tube length. A type of wound fin tubing includes slit fin tubing wherein a sheet of fin material is slit laterally and then rolled to a generally U-shaped arrangement such that the nonslit portion is wound against the tube and the slit portions extend outwardly therefrom.

To make advantageous use of wound fin heat exchangers it is necessary that the heat exchanger be configured to optimize heat transfer. Once the appropriate configuration is ascertained, the wound fin tubing should then be maintained in that configuration for the life of the heat exchanger.

There have been several methods used for mechanically securing heat exchange elements. However, the prominent methods heretofore used in the air conditioning industry for securing adjacent coils to a wound fin heat exchanger include using adhesives or mechanically deforming the coil beyond the point of elasticity such that a new configuration is maintained.

The herein disclosed apparatus not only serves to provide a support which mechanically locates and secures wound fin tubing in a desired location but additionally acts as a structural element in the heat exchanger assembly.

SUMMARY OF THE INVENTION

It is an object of the present invention to provide apparatus for supporting wound fin tubing in an appropriate heat exchanger configuration.

It is another object of the present invention to provide a support for a heat exchanger assembly while simultaneously maintaining a wound fin coil in the appropriate configuration.

It is yet another object of the present invention to provide apparatus for securing wound fin tubing as a part of a heat exchanger assembly which is easy to manufacture and convenient to assemble.

It is a still further object of the present invention to provide a tube support for use with a wound fin heat exchanger which maintains the appropriate spacing between passes in a cylindrical wound fin tube to promote high efficiency heat exchange.

It is still a further object of the present invention to provide a combination support member and tubular support means for securing the heat exchanger in the appropriate configuration and for connecting to a base pan and fan assembly of a heat exchanger unit to provide structural integrity of the entire unit.

It is a still further object of the present invention to provide a safe, economical, reliable, easy to install and manufacture support for use with wound fin tubing in a heat exchange unit.

Other objects will be apparent from the description to follow and the appended claims.

The above objects are achieved according to the preferred embodiment of the invention by the combination of a support member and a tubular support means. The support member has a vertically extending portion and top and bottom projecting portions extending outwardly from the vertical portion. The projecting portions each define an opening therein such that the tubular support means may be inserted through the openings to provide a space between the tubular support means and the support member defining an enclosed area in which the wound fin tube is secured. The vertical extending portion may additionally have a run support portion wherein each run of the wound fin heat exchanger is secured. Additionally, means for securing the tubular support means may be included such that the support is engaged in the base pan and fan assembly of the unit to structurally integrate the entire system.

DESCRIPTION OF THE PREFERRED EMBODIMENT

The embodiment as described herein is adapted for use in a heat exchange unit having a base pan and an upper fan assembly supported in relation to each other by support described. The tube support assembly is shown in a vertical position although it is to be understood that similar positions in heat exchange units might likewise be suitable for this assembly. The support will be equally applicable to wound fin heat exchangers in configurations other than cylindrical and to wound fin heat exchangers having either single or multiple row heat exchanger coils. This support assembly is likewise appropriate whether it is combined as an integral structural portion or used solely to maintain wound fin tubing in the appropriate position.

Figure 1:
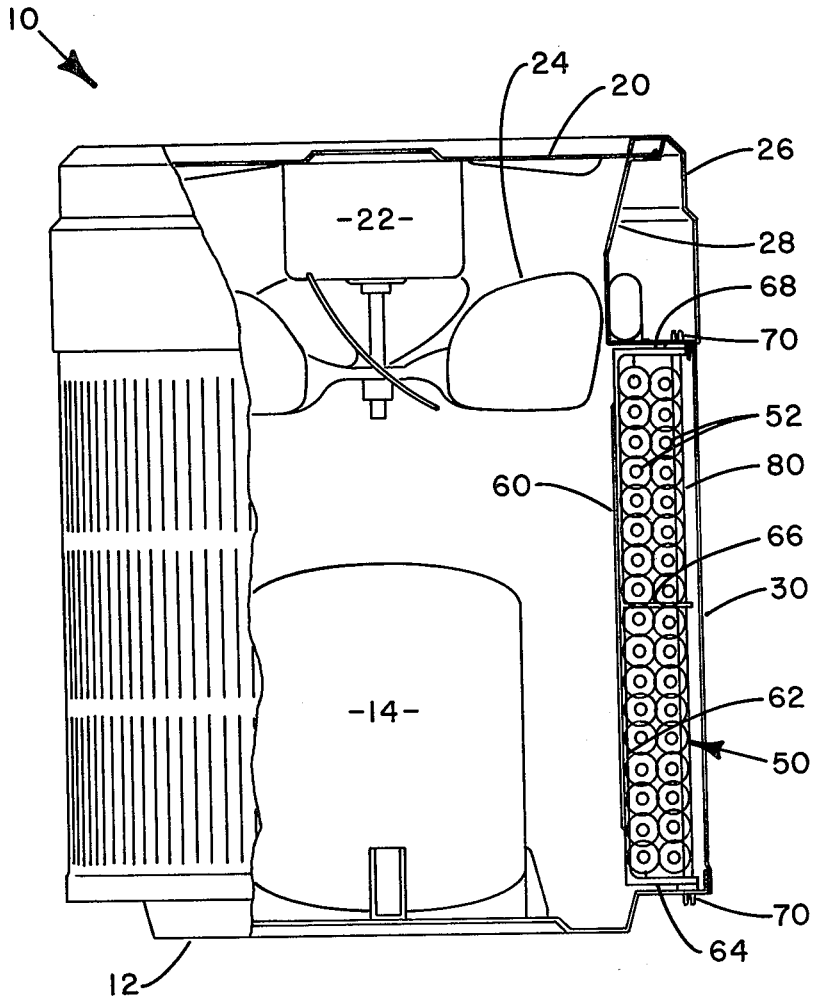
FIG. 1 is a sectional view of the heat exchange unit incorporating the tube support assembly disclosed herein.

Referring to FIG. 1 there can be seen a heat exchange unit incorporating a tube support assembly. Heat exchange unit 10 has a base pan 12 to which the remainder of the components are mounted. Base pan 12 has compressor 14 mounted in the center thereof and wound fin heat exchanger 50 mounted about the circumference of the unit. Heat exchanger 50 is formed by winding a long wound fin tube into a generally cylindrical configuration. The ends of wound fin tubes 52 are shown. Each revolution of the tube is referred to as a run herein to indicate that the wound fin tubing may be continuous about the heat exchanger. The reference to each run as a part of the heat exchanger is without delineation as to the number of circuits or other parameters within the heat exchanger.

Tube support 60 is shown having a vertical portion 62, a run portion 63 attached thereto, a top lateral portion 68, bottom lateral portion 64 and a central lateral portion 66. Each lateral portion extends outwardly from the vertical portion and has an opening therein through which support tube 80 (tubular support means) passes. Pins 70 are inserted one into each end of support tube 80 such that the pin secures the support tube and tube support 60 to base pan 12 at the bottom and to fan orifice 28 at the top.

At the upper portion of the heat exchange unit fan orifice 28 is shown as an annulus on and about the unit with top cover 26 dropping thereover to form a fan assembly. As used herein, this fan assembly shall refer to fan orifice 28 and top cover 26 as well as any of the components suspended therefrom such as grille 20, fan motor 22 and fan 24. During operation of this type of heat exchange unit ambient air directed in heat exchange relation with the refrigerant flowing through the heat exchanger is drawn through the wrapper 30 encasing the heat exchanger through heat exchanger 50 and then discharged through grille 20 at the top of the unit. Fan motor 22 and fan 24 are supported from grille 20 which is mounted to cover the opening in the center of top cover 26. Fan orifice 28 and top cover 26 serve to define a region at the top of the unit where the electrical controls of the unit may be secured. The fan orifice additionally defines an air flow pattern with fan 24 to promote efficient air flow through the unit.

Figure 2:
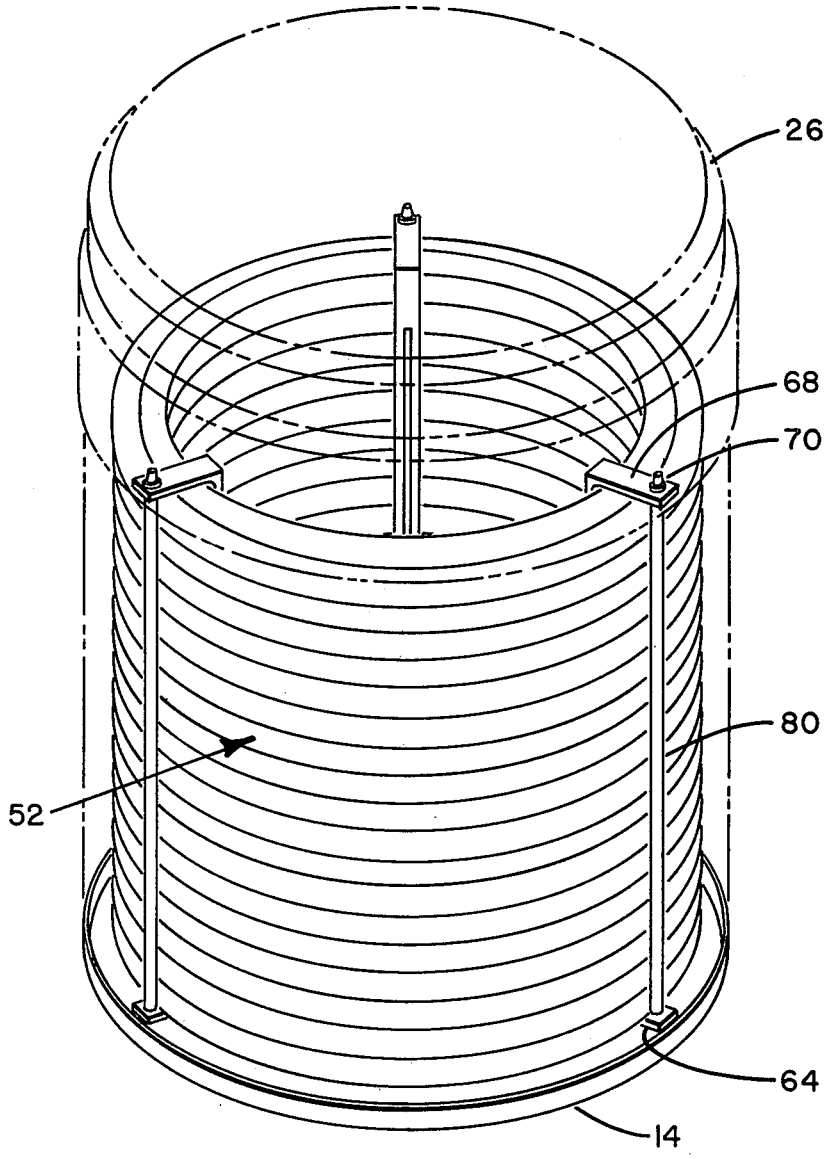
FIG. 2 is a perspective view of a heat exchanger shown in a phantom unit as secured by spaced tube support assemblies.

In FIG. 2, the two row heat exchanger 50 is shown in perspective. It can be seen that three tube support assemblies, each having tube support 60 and support tube 80, are shown spaced equidistantly about the heat exchanger. Each tube support assembly is mounted to base pan 14 as well as to the fan assembly to provide structural support for the unit.

Figure 3:
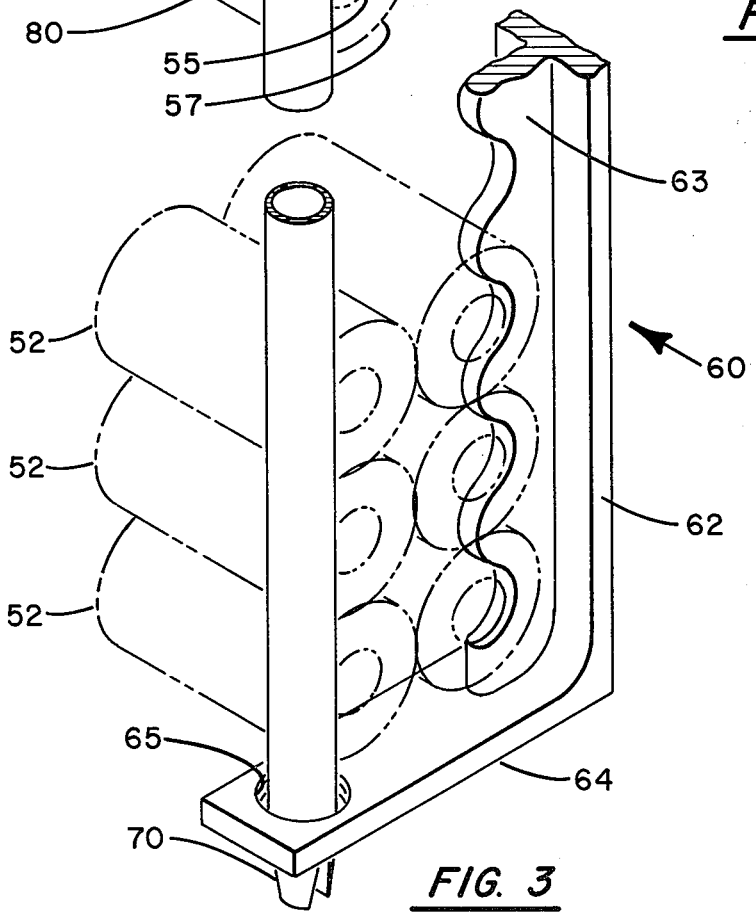
FIG. 3 is a sectional end view of a tube support assembly with runs of tubing secured therein.
Figure 5:
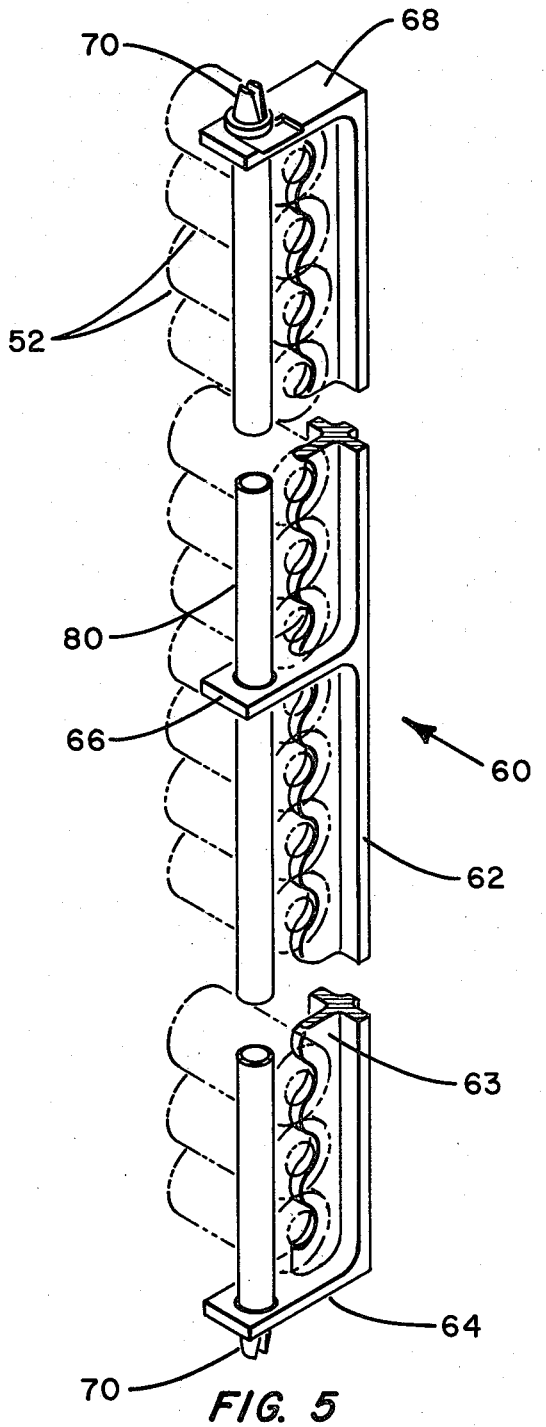
FIG. 5 is a sectional end view of the tube support assembly shown in the single row heat exchanger.

In FIGS. 3 and 5 there may be seen enlarged end views of the tube support assembly. FIG. 3 shows a two row coil and FIG. 5 shows a single row coil. In FIG. 3 tube support 60 is shown having a vertical portion 62, a run support portion 63 formed as an integral part thereof, a bottom lateral portion 64 and a top lateral portion 68. In practice a single integral molded plastic part may be formed having each of these various portions. Tube 80 is shown extending the length of the tube support 60 and located within openings 65 formed in the lateral portions 64 and 68 of the tube support. The support tube, when inserted through these openings, provides a sized region between the tube and the run support portion of the tube support such that the various runs 52 of the wound fin heat exchanger are secured therebetween. It can be seen that each run 52 has a tube 55 about which fins 57 are wrapped. The individual fins are not shown although the region these fins would occupy is outlined. Pins 70 are shown located such that they extend outwardly beyond the top and bottom lateral portions to engage other components of the heat exchange unit.

FIG. 5 additionally discloses a central lateral portion 67 extending outwardly from tube support vertical portion and generally parallel with the bottom lateral portion and the top lateral portion. The center lateral portion serves to provide additional support and likewise has an opening therein through which the support tube extends.

Figure 4:
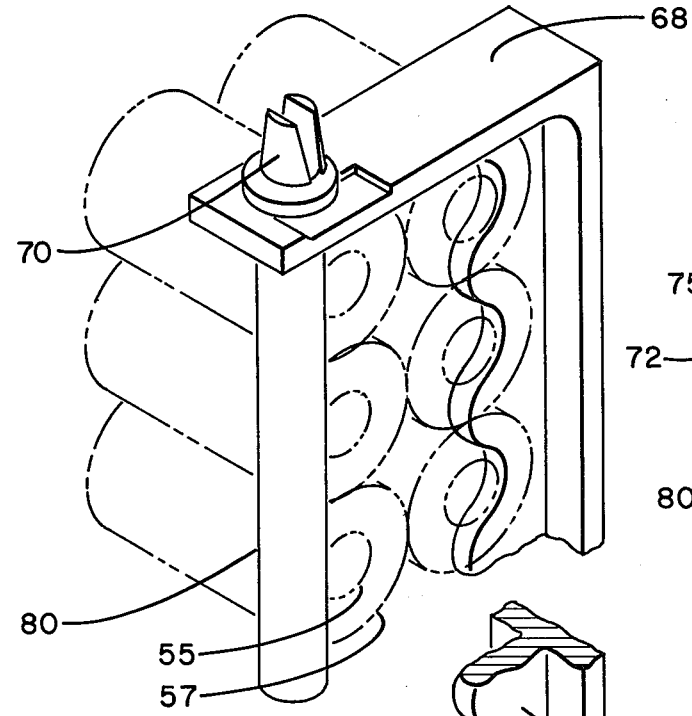
FIG. 4 is an enlarged sectional view of pins securing the tube support assembly to a separate portion of the heat exchange unit.
Figure 4:
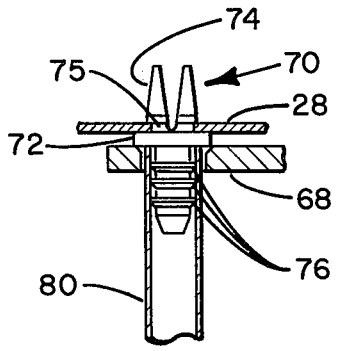

With reference to FIG. 4, it can be seen in detail the manner in which pin 70 serves to secure both tube 80 and tube support 60 to the unit base pan or the fan orifice. Specifically pin 70 has a series of pin teeth 76 extending outwardly from a portion of the pin. This portion of the pin is adapted to be inserted within tube 80 such that the pin teeth engage the interior surface of the tube and secure the tube therein. Pin spacer portion 72 is shown secured between the top lateral portion 68 of the tube support and a portion of fan orifice 28 such that a predetermined distance is maintained therebetween. Pin top 74 is a compressible portion having a pin support lip 75 which extends over a portion of fan orifice 28 securing the pin support lip to the fan orifice such that the fan orifice is maintained between the pin support lip 75 and pin spacer portion 72. Hence, as shown, the pin acts to secure tube 80 and the top of lateral portion 68 to fan orifice 28.

This tube support assembly may be secured in a heat exchange unit by first providing a wrapped fin heat exchanger in the appropriate configuration. The tube support 60 is then inserted such that the runs of tubes fall within the notches defined by the run support portion 63. Once the tube support 60 is assembled, tube 80 is inserted through the openings of the various lateral portions such that the runs of wound fin tubing are secured therebetween. Pins 70 may then be inserted into the ends of the tube support such that the tube support assembly consisting of the tube support and the support tube are independently maintained. Upon assembly of the heat exchange unit, the top portions 74 of the pin are compressed to slide through the openings in the fan orifice or the base pan, and after insertion therethrough, are allowed to expand such that pin support lip 75 secures the fan orifice or the base pan to the tube support assembly.

The above invention has been described in reference to a specific embodiment. It is to be understood that variations and modifications can be made within the spirit and scope of the invention.

I claim:

1. A heat exchange unit having a base pan for supporting the unit, and a fan assembly and a subassembly which comprises:

a heat exchanger formed from a plurality of runs of wound fin tubing:

a support member having a vertically extending portion extending the height of the heat exchanger and having a top lateral portion and a bottom lateral portion both extending across the runs of wound fin tubing, each lateral portion defining an opening therein;

a tubular support means extending through the openings in the lateral portions of the support member securing the runs of wound fin tubing between the tubular support means and the support member; and means for securing the tubular support means to the base pan and to the structural assembly for incorporating the subassembly as an integral part of the heat exchange unit.

2. The apparatus as set forth in claim 1 wherein the support member further comprises a run securing portion affixed to the vertically extending portion, said run securing portion defining notches adapted to each receive and secure a single run of wound fin tubing.

3. The apparatus as set forth in claim 1 wherein the support member further comprises an intermediate lateral portion having an opening therein for the receipt of the tubular support means, said intermediate lateral portion extending from the vertically extending portion between the top lateral portion and the bottom lateral portion.

4. The apparatus as set forth in claim 1 wherein the heat exchanger is formed by bending the wound fin tubing into a generally cylindrical configuration, wherein there are at least three subassemblies spaced about the heat exchanger each serving to secure the runs of the heat exchanger and each serving as a support between the base pan and the structural assembly.

5. The apparatus as set forth in claim 1 wherein the means for securing comprises at least one pin adapted to fit inside the tubular support means for securing the tubular support means to either the base pan or the structural assembly.

* * * * *